United States Patent [19]

Bibeau

[11] Patent Number: 4,649,981

[45] Date of Patent: Mar. 17, 1987

[54] EDGE SEAL FOR FABRIC COVERS

[75] Inventor: Robert E. Bibeau, West Brattleboro, Vt.

[73] Assignee: Appropriate Technology Corporation, Brattleboro, Vt.

[21] Appl. No.: 709,071

[22] Filed: Mar. 7, 1985

[51] Int. Cl.[4] ..... E06B 9/08

[52] U.S. Cl. ..... 160/120; 160/273 R

[58] Field of Search ..... 160/120, 270, 271, 272, 160/273 R, 273 C

[56] References Cited

U.S. PATENT DOCUMENTS

| | | | |
|---|---|---|---|
| 27,103 | 2/1860 | Burchell | 160/273 |
| 187,894 | 2/1877 | Osgood | 160/273 |
| 275,712 | 4/1883 | Roelofs . | |
| 300,562 | 6/1884 | Bishoprick | 160/273 |
| 669,967 | 3/1901 | Solomon . | |
| 730,441 | 6/1903 | Duchemin | 160/273 R |
| 1,233,658 | 7/1917 | Forner | 160/273 |
| 1,583,133 | 3/1926 | Fierman | 160/268.5 |
| 1,613,967 | 1/1927 | Stewart | 160/273 |
| 1,819,360 | 8/1931 | Dixson | 160/272 |
| 1,882,982 | 10/1932 | Schmiedeskamp | 160/273 R |
| 2,336,692 | 12/1943 | Lubetsky | 160/120 |
| 2,349,226 | 5/1944 | Thomas | 160/273 |
| 2,383,015 | 8/1945 | Pratt | 160/265 |
| 2,407,784 | 9/1946 | Hoffstad | 160/273 R |
| 2,501,454 | 3/1950 | Schueren | 160/273 |
| 2,521,455 | 9/1950 | Gorgun | 160/239 |
| 2,908,326 | 10/1959 | Jewell | 160/273 R X |
| 3,017,927 | 1/1962 | Demko | 160/271 |
| 3,116,097 | 12/1963 | Novales | 160/271 X |
| 3,149,665 | 9/1964 | Handford | 160/272 X |
| 3,990,635 | 11/1976 | Restle et al. | 237/1 A |
| 4,079,772 | 3/1978 | Klaenhammer et al. | 160/268 R |
| 4,151,871 | 5/1979 | Ryan | 160/120 X |
| 4,220,189 | 9/1980 | Marquez | 160/23 R |
| 4,246,952 | 1/1981 | Helldorfer | 160/271 |
| 4,258,517 | 3/1981 | Hammond | 160/269 |
| 4,313,484 | 2/1982 | Shore | 160/121 R |
| 4,333,511 | 6/1982 | Johnston | 160/271 X |
| 4,374,536 | 2/1983 | Becker | 160/84 R |
| 4,408,650 | 10/1983 | Verch | 160/121 R |
| 4,418,739 | 12/1983 | Woolnough et al. | 160/120 |
| 4,516,618 | 5/1985 | Gardner et al. | 160/120 |

FOREIGN PATENT DOCUMENTS

| | | | |
|---|---|---|---|
| 1379077 | 10/1964 | France | 160/272 |

*Primary Examiner*—Ramon S. Britts
*Assistant Examiner*—David M. Purol
*Attorney, Agent, or Firm*—Wolf, Greenfield & Sacks

[57] ABSTRACT

An edge seal for fabrics such as insulating window shades is disclosed. The seal is formed by tracks disposed on each side of fabric when the fabric is drawn and the tracks receive the fabric margins. A lip is provided on each track, which interlock with flaps cut in the margins to hold the margins in the tracks even when forces are applied to the fabric which would ordinarily pull the margins out of the tracks.

16 Claims, 17 Drawing Figures

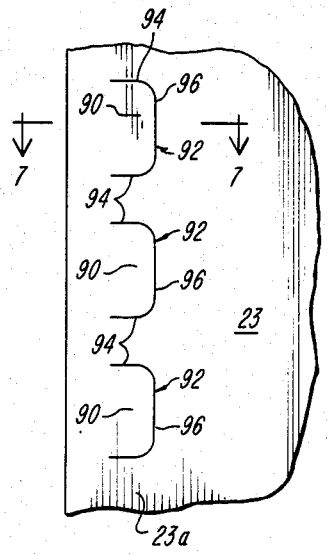
FIG. 6
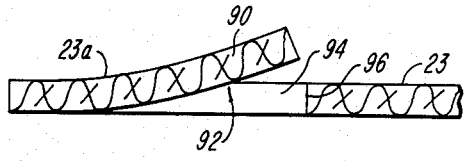
FIG. 7
FIG. 8
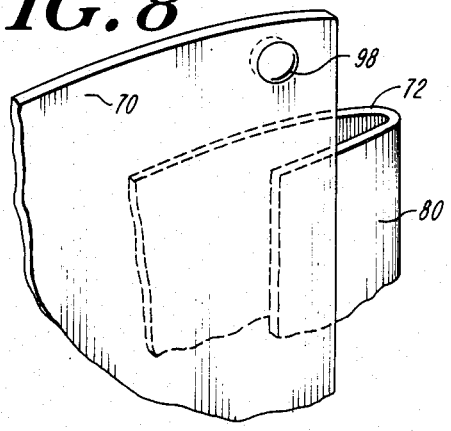
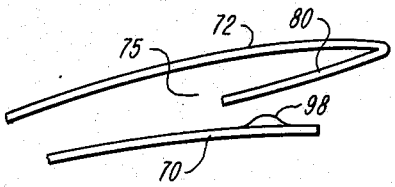
FIG. 9
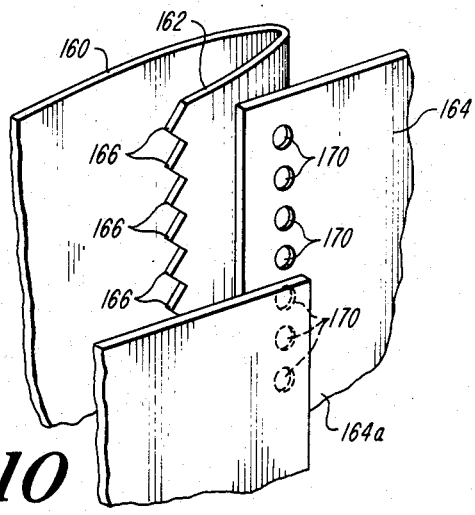
FIG. 10

EDGE SEAL FOR FABRIC COVERS

INTRODUCTION

This invention relates to edge seals for fabric covers and more particularly comprises a new and improved retaining and sealing system for insulating shades used on windows and other closures. The invention has application in any installation employing a fabric that is spread across an opening and which is provided with side tracks that receive and engage the fabric edges.

The decline of world hydrocarbon resources and the growth of population has necessitated better thermal control in all types of buildings. The most obvious object of concern is the heat loss suffered through windows and other glass closures. The use of insulating shades on windows has greatly increased during the past decade, and substantial time and money have been spent to improve the performance of such insulating shades. This invention has particular application to insulating window shades.

Many types of insulating shades are used in combination with tracks mounted on the sides of the window frame to enclose the shade edges. A variety of different techniques have been employed to capture the edges of the shade in the track. Some of the techniques suggested have proved to be economically impractical, and other techniques have proved impractical for they detract from the aesthetic appeal of the shades or make them difficult to use. Other techniques have proved to be undependable or have added so much bulk to the shade that the shades could not be rolled up in a sufficiently small volume.

The principal object of the present invention is to provide a retaining and sealing system for insulating shades, which does not adversely effect the aesthetics of the shade and which is functionally dependable.

Another important object of this invention is to provide a retaining and sealing system for insulating shades, which does not appreciably add to the cost of manufacture of the system.

Still another important object of this invention is to provide a retaining and sealing system for insulating shades, which does not require the addition of any material to the shade sheet and which therefore does not increase the space required to store the sheet when it is retracted onto its roller.

Still another important object of this invention is to provide a retaining and sealing system for insulating shades which provides a positive interlock between the shade edges and a sealing track so as to retain the edges of the shade in place even when substantial pressures are exerted on the shade material.

Yet another important object of this invention is to provide a retaining and sealing system for insulating shades, which while providing a positive interlock between the shade edges and a track, may be easily reactivated if for any reason the shade edges are withdrawn from the track.

Another object of this invention is to provide an edge sealing system for insulating shades that has application with shades of one or more panels.

To accomplish these and other objects, this invention includes a roll or other source of insulating shade material which is adapted to be mounted on the inside of a window and to be drawn over it. A pair of tracks are mounted on opposite sides of the window frame and are open in a direction facing one another. When the shade is drawn over the window, the edges of the shade extend into the tracks. A lip is formed as part of each track and extends away from the adjacent side edge of the shade. Each lip has a continuous free edge, and the edges of the lips in the opposite tracks face away from one another. A plurality of slits are cut in the shade material adjacent the side edges thereof and define flaps in the shade. The flaps are positioned to hook about the free edges of the lips when the shade is drawn and thereby prevent the edges of the shade from being pulled out of the tracks when the face of the shade is subjected to wind or other force imposed in a direction perpendicular to the plane of the shade.

These and other objects and features of this invention will be better understood and appreciated from the following detailed description of several embodiments thereof, selected for purposes of illustration and shown in the accompanying drawing, in which:

BRIEF FIGURE DESCRIPTION

FIG. 6 is a fragmentary elevation view of one side edge of the shade;

FIG. 7 is a fragmentary cross-sectional view of the shade taken along section line 7—7 in FIG. 6;

FIG. 8 is a fragmentary perspective view of the upper portion of the sealing assembly;

FIG. 9 is a fragmentary top view of the assembly of FIG. 8.

FIG. 10 is an exploded view of another embodiment of edge seal in accordance with this invention;

DETAILED DESCRIPTION

In the following description the invention is primarily described as applied to a roll-up type insulating window shade. However, the invention has substantial applicability to other settings. Thus, the shade material is not in all applications made of an insulating material and the opening covered by the shade is not a window. Some of the other uses of the invention are suggested or described in the following specification.

Figure 1:
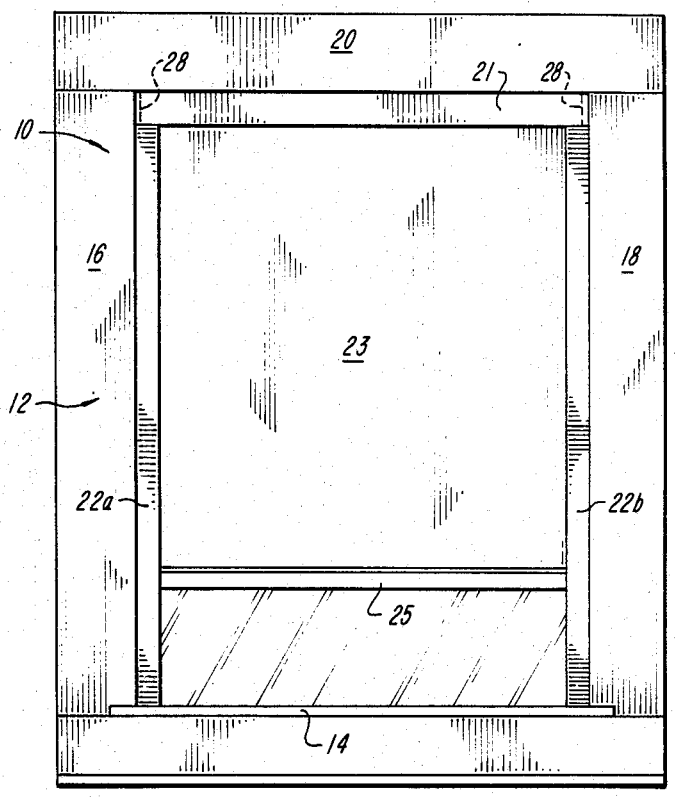
FIG. 1 is a front elevation view of an insulating shade installed on the inside of a window frame, partly drawn, and constructed in accordance with this invention.

In FIG. 1 an insulating shade assembly 10 is shown mounted on a window frame 12. The frame 12 includes a sill 14, left and right jambs 16 and 18, and a lintel 20. The window itself may be of any variety; the window configuration per se is not part of the present invention.

The shade assembly 10 is shown mounted within the jambs 16 and 18 and lintel 20. It is to be understood, however, that the assembly may also be mounted on the faces of the jambs and lintel. A valance 21 which covers the shade roller mechanism is mounted on the lintel 20, while edge tracks 22*a* and 22*b* are mounted on the jambs 16 and 18. A pair of brackets 28 are secured to the inner faces of jambs 16 and 18 at each end of the valance 21, and roller 30 which carries the shade material 23 is supported on the brackets. While the invention is shown and described embodied in a roll-up shade, it is to be understood that it has application to other forms of shades as well. For example, the shade could be pleated with accordian-like folds and stored behind the valance 21. The roll-up type of shade, however, is most typical of its applications.

Figure 2:
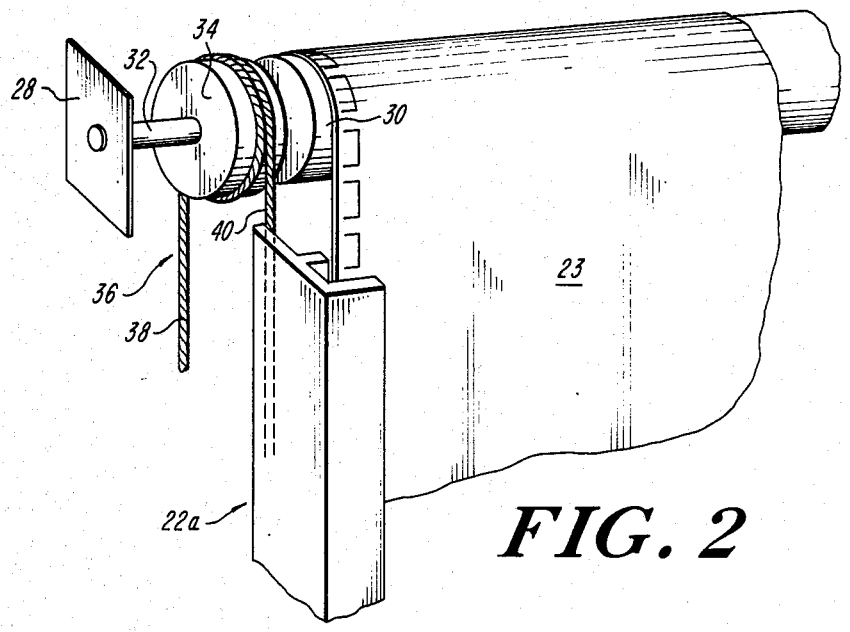
FIG. 2 is a fragmentary perspective view of upper portion of the shade and showing parts of the shade roller, pulley system for lowering and raising the shade, and the side track.

As shown in FIG. 2, the roller 30 is directly supported by shaft 32 which also carries a pulley 34 about which several turns of the pull cord 36 are wound. The brackets 28 on the jambs carry the shaft 32. The two ends 38 and 40 of the cord enable the operator to raise and lower the shade as desired. Obviously, when the shade is to perform its insulating function, it is fully drawn over the window below the position shown in FIG. 1. However, when the shade is used for privacy or to shade the inside of the building from the sun, or for any other purpose, it may be drawn to an intermediate position. The pulley 34 may, of course, be mounted on a separate shaft parallel to shaft 32, and the two shafts may be geared together in the conventional manner so as to enable the cord 36 to raise and lower the shade. Furthermore, the cord controlled roller configuration of FIG. 2 may be replaced by a conventional spring loaded roller for retracting the shade but yet permitting the shade to be drawn over the window. The details of the mechanism used to operate the shade do not form part of the present invention.

Insulating shade 23 may be made in a variety of different forms, and its particular makeup, that is, the particular material from which the shade is made, is no part of the present invention. Normally, however, the shade is made of an opaque material having good thermal insulating properties. The shade may, for example, be quilted and/or be laminated of several layers of material sealed or seamed together as is well known in the art. Ordinarily, the shade carries a weighted batten 25 at its lower edge.

Figure 3:
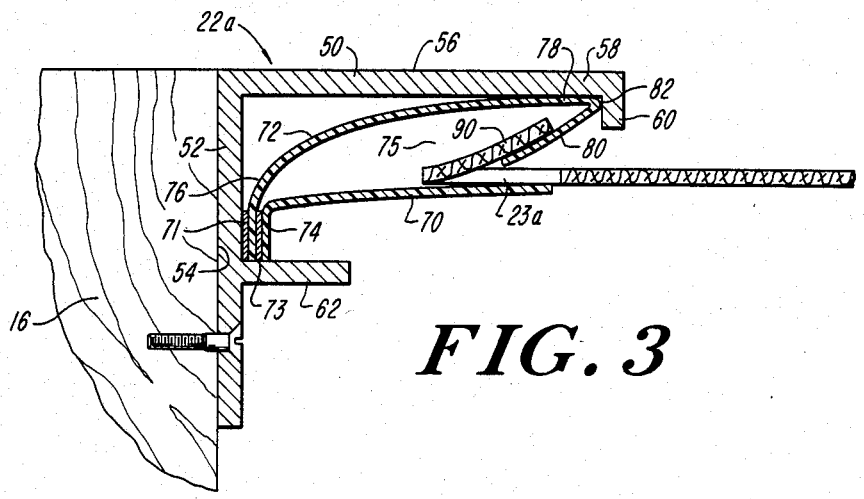
FIG. 3 is a fragmentary view of the track and margin of the shade material taken along the section line 3—3 in FIG. 1.

As recited above, the purpose of this invention is to provide an effective insulating seal at the margins of the shade material 23 and to mechanically retain the edges of the shade in the sealing position within tracks 22*a* and 22*b* against imposed forces directed perpendicular to the shade surface, which have a tendency to pull the shade edges from the tracks. In FIG. 3 one embodiment of the track and shade assembly for accomplishing this purpose is shown in detail. In the embodiment shown in FIG. 3, the track 22*a* includes an extrusion 50 which is F-shaped in cross section and made of aluminum, plastic or other suitable and relatively rigid material. The stem or side wall 52 of the extrusion 50 is screwed to the inner surface 54 of jamb 16, and the track extends substantially the full height of the jamb from the lintel 20 to the sill 14. The track 22*b* on the opposite jamb 18 is the mirror image of the track 50. Because the two sides are essentially identical, only one track assembly need be described.

The cap 56 of extrusion 50 is disposed on the side of the shade assembly away from the window so as to form a continuous vertical flange that covers the inner workings of the track assembly. The free edge 58 of the flange 56 has a lip 60 which provides a trap to retain the sealing members within the track in position. The sealing members are also retained in place by the intermediate flange 62 of the F-shaped extrusion.

A pair of flexible plastic panels 70 and 72 made of Mylar or some similar material are shown in FIG. 3 to be mounted within the track 50. The panels 70 and 72 function together to define a channel 75 within which the edge 23*a* of the shade sheet extends. The panels 70 and 72 may be integrally formed from a single plastic sheet folded at the adjacent panel edges 74 and 76, or the panels 70 and 72 may be formed separately from one another. The panels 70 and 72 may be secured in place in track 22*a* by adhesive strips as suggested at 71 and 73, or they may be nailed or otherwise secured to the track and to each other.

The panel 72 is folded over at its other edge 78 so as to form a lip 80 that extends toward the side wall 52 of the extrusion. Fold 82 which forms the lip 80 is shown positioned against the lip 60 at the free edge of flange 56 of the track 22*a*. The lip 80 cooperates with the flaps 90 formed adjacent the edge 23*a* of the shade sheet 23, as is more fully described below.

In FIGS. 2, 6 and 7 the one edge 23*a* of shade 23 is shown to have a series of U-shaped slits 92 extending completely through the shade material adjacent the edge 23*a*. Identical slits are provided along each edge of the shade sheet. The slits 92 include horizontal sides 94 joined by vertical slit 96 at their ends remote from the shade edge 23*a*. The slits 92 thereby define flaps 90 in the shade which are effectively hinged to the main plane of the shade material at the open ends of the U-shaped slit 92. In FIG. 7 the flap 90 is shown displaced from the plane of the shade. In that position, the flap 90 may engage the lip 80 of the panel 72 in the manner shown in FIG. 3 so that the edge 23*a* of the shade is captured between the panels 70 and 72. The panel 70 preferably is biased to bear against the lip 80 so as to form a surface seal against the margin of the shade 23*a* when the shade is disposed between the panels. It is to be understood that the flaps and slits need not be U-shaped but may take other configurations as well. For example, they may be V-shaped, M-shaped or other shape, and the shape will in part be determined by the stiffness and other characteristics of the shade material.

In FIG. 8 the panel 70 is shown to extend slightly above the panel 72 and its lip 80, and the upper portion of the panel 70 above the upper edge of lip 80 carries a protrusion 98 that extends toward the plane of the panel 72. The protrusion 98 serves to displace the flaps 90 in the shade out of the plane of the shade as each enters between the panels 70 and 72 so as to be in a position to fall behind the lip 80 and engage it as illustrated in FIG. 3. Thus, as the shade is drawn from its fully retracted position on roller 30, downwardly across the window with the margins 23*a* of the shade in the channels 75 defined by the panels 70 and 72, the flaps 90 are displaced by the protrusions adjacent each side edge of the shade so as to cause the flaps to engage the lips 80 to lock the shade margins in the channels.

It will be apparent from an inspection of FIG. 3 that the interlock of the flaps 90 with the lip 80 creates a very substantial resistance to withdrawal of the margin of the shade from the channels defined by the panels. If, however, the margin of the shade is withdrawn from the channel, the operator need only elevate the shade, that is retract the shade onto the roller by means of the cord 36 and again lower the shade with the shade margins 23*a* within the channels defined by the panels in the respective tracks on each side of the window.

Figure 4:
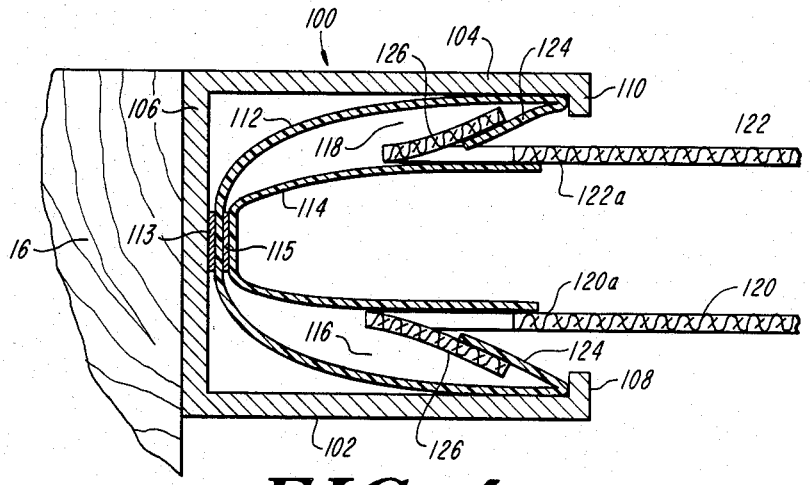
FIG. 4 is a cross-sectional view similar to FIG. 3 and showing another embodiment of the invention as it may be utilized in a double shade assembly.

In FIG. 4 a shade assembly having two panels is shown but each panel seals in the channels formed by the flexible panels in the same fashion as the single panel shade in the embodiment of FIG. 3. In FIG. 4 track 100 is U-shaped but may be made as an extrusion in the same manner as the extrusion 50 of track 22. Track 100 has inner and outer flanges 102 and 104, end wall 106 which is secured to the lintel 16, and lips 108 and 110 at the ends of the flanges 102 and 104. Within the channel 100 a pair of U-shaped flexible sheets 112 and 114 are mounted, and the two flexible sheets define a pair of channels 116 and 118 adapted to receive the margins 120*a* and 122*a* of the shades 120 and 122, respectively. The margins of the U-shaped sheet 112 are provided with lips 124 which extend into the channels 116 and 118 and toward the wall 106 of the track 100 in precisely the same manner as the lip 80 in the embodiment of FIG. 3. The margins 120*a* and 122*a* of the shade panels are in turn provided with flaps 126 identical to the flaps 90 as shown in FIGS. 2, 6 and 7, and the flaps 126 cooperate with the lips 124 precisely in the manner described above in connection with the first embodiment. The shades 120 and 122 are supported independently on their own rollers and may be drawn simultaneously or separately. Protrusions similarly are formed at the upper margins of the inner U-shaped sheet 114 to displace the flaps 126 and cause them to engage the lips 124 as each shade is drawn with its margins in the channels. As in the embodiment of FIG. 3, the panels 112 and 114 may be attached to the track 100 and to one another by adhesive strips 113 and 115, or by any other fastening means.

Figure 5:
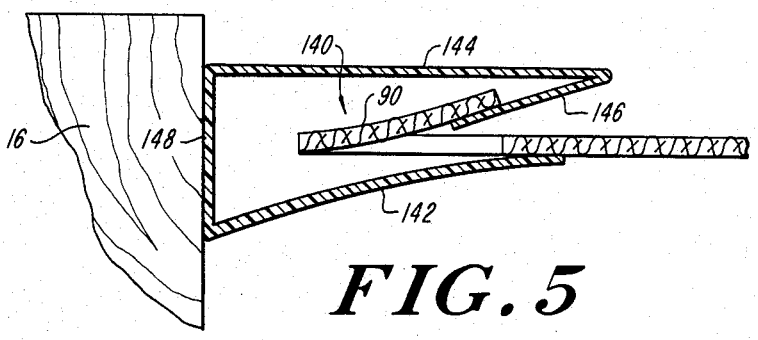
FIG. 5 is a cross sectional view of yet another embodiment of the invention.

In FIG. 5 yet another embodiment is shown wherein the channel is defined by the track itself as opposed to an insert in the form of flexible panels as in the embodiments of FIGS. 3 and 4. In this embodiment the channel 140 has panels 142 and 144 that correspond to the panels 70 and 72 in the embodiment of FIG. 3. However, the panels are not mounted within a rigid track as in the other embodiments, but rather are self-supporting although they may be somewhat flexible to provide the surface-to-surface seals about the margins 23*a* of the shade 23. The panel 144 includes a lip 146 extending toward the jamb 16 and which is positioned to engage the flap 90 just as in the other embodiments. The panels 142 and 144 along with lip 146 and the end wall 148 secured to the jamb 16 may be made as a unitary structure and typically may be an extrusion of a semi-rigid plastic material. The panel 142 is shown biased in the direction of lip 146 so as to bear against it except when the margin 23*a* of the shade is interposed between the two as in FIG. 5. And as in the other embodiments and as suggested in FIGS. 8 and 9, the panel 142 carries a protrusion which will deflect the flap 90 from the plane of the shade so that it may lodge behind the lip 146 in the manner suggested.

In FIG. 10 yet another embodiment is shown. In this embodiment the sealing lip is serrated and the flaps at the margins of the shade are replaced by holes which are engaged by the serrated lip. More particularly, in FIG. 10 panel 160 made of a flexible plastic material like that in panels 70, 72, 114 and 116 has a lip 162 extending away from the shade 164, and the free edge of the lip is serrated to provide teeth 166 facing in the direction of the plane of shade. The teeth 166 are pointed in a direction to enter the holes 170 in the shade adjacent the margin 164*a*. The teeth 166 have sufficient flexibility to allow them to enter and slip out of the holes 170 as the shade is drawn and raised by the operator. The teeth 166 will, however, engage the holes 170 when the shade is drawn to retain the margin 164*a* in the channel defined by the panels 160 and 172.

Figure 11:
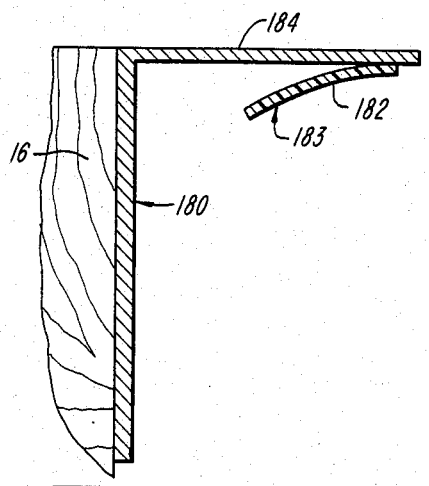
FIGS. 11 and 12 are fragmentary cross-sectional views of two additional embodiments of track made in accordance with this invention.
Figure 12:
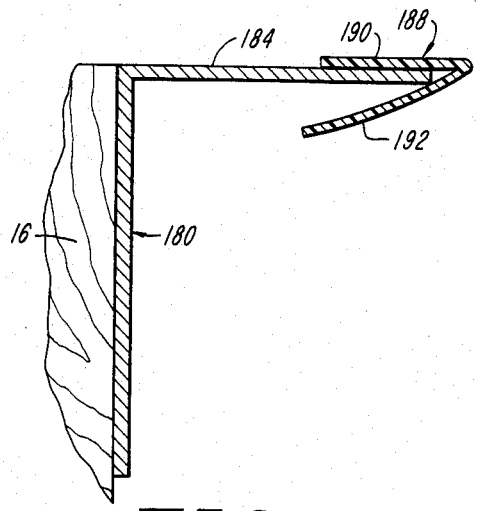

In FIGS. 11 and 12 other embodiments of the track assembly are shown, which may be less expensive ways of achieving substantially the same results as achieved with the preferred embodiments described above. In both figures an L-shaped extrusion 180 is employed as the track, and in FIG. 11 the lip 182 is formed by adhering a plastic panel 183 to the inside of the flange 184 which is on the edge of side wall 186 away from the window. The panel 183 is bent away from the flange 184 to provide room for the flaps 90 at the margins of the shade. In FIG. 12 the panel 188 is V-shaped and straddles the flange 184. The side 190 of panel 188 is adhered to the front of flange 184 while the side 192 lies behind it and defines a lip to engage the flaps 90 at the margin of shade. Each of the configurations of FIGS. 11 and 12 may be used in combination with another panel to form an enclosing channel as in FIGS. 3–5, although in an inexpensive form of the invention, the second panel may be omitted, particularly if the shade material is sufficiently stiff so that the flaps 90 and lip will form a positive interlock that will withstand substantial forces against the shade.

Figure 13:
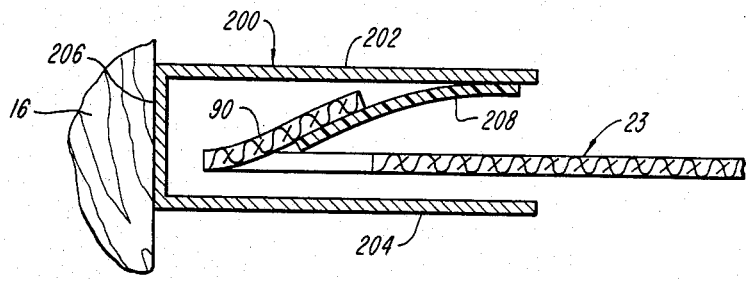
FIG. 13 is a fragmentary cross-sectional view similar to FIG. 5 and illustrating yet another embodiment of this invention.

In FIG. 13, yet another form of the invention is illustrated, similar to the embodiment of FIG. 5. In this embodiment the track 200 is an extruded channel having parallel flanges 202 and 204 and a side wall 206. A thin and somewhat flexible strip 208 which serves as a lip may be adhered to the inside of flange 202 and extend toward wall 208. The flap 90 of the shade 23 lies behind the lip 208 just as in the other embodiments to retain the margin of the shade in the track. A protrusion (not shown) may be formed at the top of the flange 204 on its inside surface to deflect the flaps 90 from the plane of the shade when the shade is lowered. If the flanges 202 and 204 are spaced close enough together and the shade material has sufficient bulk, the shade may form a surface to surface seal against the lip and/or flange 204.

Figure 14:
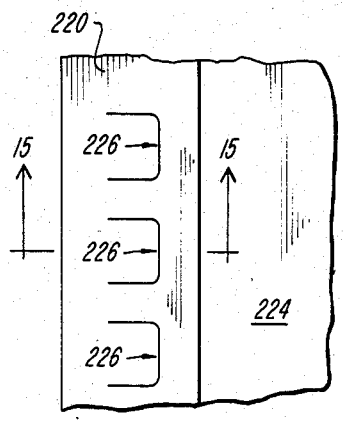
FIG. 14 is a fragmentary elevation view similar to FIG. 7 showing another embodiment of shade constructed in accordance with this invention.
Figure 15:
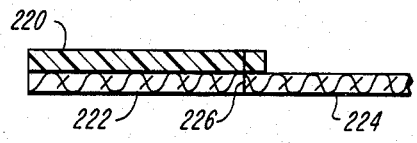
FIG. 15 is a cross-sectional view of the shade of FIG. 14 taken along section line 15—15 and with the flap in the inactive position.
Figure 16:
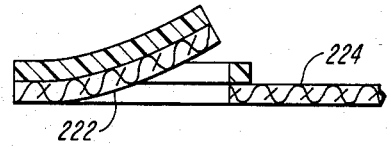
FIG. 16 is a cross-sectional view like FIG. 15 but with the flap in the active position.

In FIGS. 14–16 another shade construction is shown. In that embodiment, a reinforcing strip 220 is shown secured to the margin 222 of the shade sheet 224, and the U-shaped slits 226 are cut through both the strip 220 and the shade sheet 224. The reinforcing strip may be desirable, particularly when the sheet is a thin and/or very soft material so that flaps without backing would have insufficient stiffness when engaging a lip to resist any meaningful force applied to the shade which would tend to pull the shade margin from the track. Even though in this embodiment some bulk is added to the shade by the strip, the flap nevertheless does fold into the plane of the shade with the strip when not in use as shown in FIG. 15. Consequently, the shade will roll up into a rather compact package and store neatly behind the valance 21.

Figure 17:
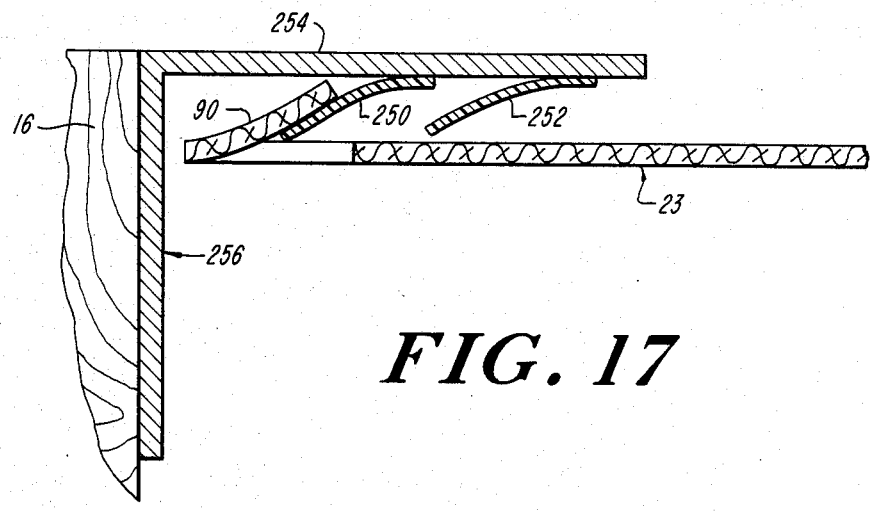
FIG. 17 is a fragmentary cross-sectional view of still another embodiment of the invention.

FIG. 17 suggests still another modification of the invention, which may be incorporated into many of the previously described embodiments. It is particularly useful when the window frame or other structure to receive the cover is out of square, that is, the sides of the frame are not precisely parallel with one another. To compensate for such a condition, two lips 250 and 252 are carried on the inside of the flange 254 of track 256, and the flap 90 of the shade 23 is shown engaging the inner lip 250. If, however, the tracks on the sides of the frame diverge slightly, the flaps 90 at the wider region may engage the lips 252 on each side that are closer together. This arrangement may, of course, also be employed in any setting where it is desired to impose different tensions on the shade. It also generally provides added protection by presenting a second locking means for the margin of the shade in the track if for any reason the flaps are pulled free from the innermost lips in the tracks.

In the preferred embodiments of this invention, a surface-to-surface seal is formed between the margin on the shade and the panels such as 70, 114 and 142 on the side of the shade margin nearer the window and such as the lips 80, 124 and 146 on the other side of the shade margins away from the window. The slits which define the flaps 90 are hidden from view behind the panels so that they do not detract from the appearance of the shade assembly. Further, because in the preferred embodiment no added material is applied to the margins of the shades and the flaps lie within the plane of the shade sheet when not in use, the shades may be rolled on their rollers without increasing the volume of shade behind the valance 21. Furthermore, the panels which define the channels and lip that engage the margins may be made of an inexpensive material so as not to appreciably add to the cost of the assembly, and if the panels become worn or are damaged in any way, they may readily be replaced.

Having described the invention in detail, those skilled in the art will appreciate that numerous modifications may be made of the invention without departing from its spirit. Therefore, it is not intended that the scope of this invention be limited to the specific embodiments illustrated and described. Rather, it is intended that the scope of the invention be determined by the appended claims and their equivalents.

What is claimed is:

1. An insulating shade assembly for insulating an object, said assembly comprising:

a roller mounted at one end of the object to be insulated;

a shade secured at one end to the roller and adapted to be rolled upon the roller for storage and to be drawn from the roller when desired to cover the object to be insulated, said shade having parallel side edges and being disposed generally in a plane when drawn;

a pair of channels, one on each side of the object to be insulated, each channel being aligned with one side edge of the shade when the shade is drawn over the object to be insulated;

a lip secured to each channel and extending generally away from the shade and toward its respective channel, each of said lips having a free edge which is parallel to the corresponding side edge of the shade when the shade is drawn from the roller;

flaps disposed adjacent each side edge of the shade, said flaps being cut from the shade and being pivotable out of the plane of the shade, each of said flaps engaging the free edge of an associated one of said lips when the shade is drawn over the object to be insulated to maintain the shade in place when a force is applied to the shade in a direction toward or away from the object to be insulated; and means for positioning each flap over the free edge of its associated lip when the shade is drawn.

2. An insulating shade assembly as defined in claim 1 wherein said means for positioning is disposed adjacent an end of each lip between the roller and the lip for positioning each flap over the free edge of its associated lip when the shade is drawn.

3. An insulating shade assembly as defined in claim 1 wherein said flaps are defined by U-shaped cuts in the shade and wherein said flaps are integral with the shade and are pivotable with respect to the shade along a line adjacent the side edges of the shade.

4. An insulating shade assembly as defined in claim 1 wherein said channels are shaped and positioned to receive the side edges of the shade when the shade is drawn, and wherein said free edges of the lips lie within the channels.

5. An insulating shade assembly as defined in claim 4 wherein said flaps are movable into the plane of the shade so as not to interfere with the rolling up of the shade and so as not to increase the thickness of the shade at its edges when rolled up.

6. An insulating shade assembly as defined in claim 1 further comprising tracks made of rigid material carrying the channels on each side of the shade.

7. An insulating shade assembly as defined in claim 1 further comprising a second shade, an additional pair of channels and additional lips to provide a double insulating shade assembly.

8. An insulating shade assembly as defined in claim 1 wherein said channels are made of a semi-rigid material so to be self supporting on each side of the shade.

9. An insulating shade assembly as defined in claim 1 further comprising a cutout in the shade disposed directly opposite each flap, each cutout having a shape and size substantially equal to that of its associated flap for receiving its associated flap in the plane of the shade prior to rolling up of the shade on the roller.

10. An insulating shade assembly as defined in claim 1 further comprising a panel disposed in each channel for capturing an associated side edge of the shade.

11. An insulating shade assembly as defined in claim 10 wherein said panel is biased to bear against the lip disposed in the channel to form a surface seal with the associated side edge of said shade.

12. An insulating shade assembly as defined in claim 10 comprising a second panel in each channel and wherein said two panels and said lip in each channel are integrally formed from a unitary, folded plastic sheet.

13. An insulating shade assembly as defined in claim 2 wherein said positioning means comprises a protrusion, said protrusion extending generally normal to the plane of the shade to displace each flap out of the plane of the shade as it passes over the protrusion.

14. An insulating shade assembly as defined in claim 1 further comprising, within each channel, a second lip extending generally away from the shade and toward its respective channel, said second lip in a direction being spaced from said lip toward said shade for engaging ones of said flaps not engaged by said lip when said shade is drawn over the object to be insulated.

15. An insulating shade assembly as defined in claim 1 wherein each of said lips is formed of a flexible material.

16. A shade assembly comprising:

shade storage means mounted at one end of an object to be covered; a shade secured at one end to the storage means and adapted to be drawn from the storage means when desired to cover the object to be covered, said shade having parallel side edges and being disposed generally in a plane when drawn;

a pair of tracks, one track being on each side of the object to be covered, each track being aligned with one side edge of the shade when the shade is drawn over the object to be covered;

a lip secured to each of the tracks and extending generally away from the shade, each of said lips having a free edge which is parallel to a corresponding side edge of the shade when the shade is drawn from the storage means;

flaps cut from the shade and being pivotable from a first inactive position generally in the plane of the shade to a second active position out of the plane of the shade, said flaps engaging the free edge of an associated one of the lips when the shade is drawn over the object to be covered to maintain the shade in place when a force is applied to the shade in the direction toward or away from the objection to be covered; and means for positioning each flap over the free edge of its associated lip when the shade is drawn.

* * * * *